US006230361B1

(12) United States Patent
Griffin

(10) Patent No.: US 6,230,361 B1
(45) **Date of Patent: *May 15, 2001**

(54) DUST PAN CLOSURE FOR A VACUUM CLEANER

(75) Inventor: Ronald Griffin, Williamsport, PA (US)

(73) Assignee: Shop Vac Corporation, Williamsport, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/464,547

(22) Filed: Dec. 15, 1999

(51) Int. Cl.[7] ..... A47L 5/38

(52) U.S. Cl. ..... 15/310; 15/327.2; 15/339; 15/352

(58) Field of Search ..... 15/310, 327.1, 15/327.2, 328, 339, 352

(56) References Cited

U.S. PATENT DOCUMENTS

| | | | |
|---|---|---|---|
| 442,567 | 4/1984 | Pravettone . | |
| 918,896 | 4/1909 | Noe . | |
| 1,104,882 | 7/1914 | Ferguson . | |
| 1,759,242 | 5/1930 | Nielsen . | |
| 2,051,728 | 8/1936 | Manning . | |
| 2,247,549 | 7/1941 | Frederick . | |
| 2,475,815 | 7/1949 | Burd . | |
| 2,539,257 | 1/1951 | Limberg . | |
| 2,608,709 | 9/1952 | Benjamin . | |
| 2,635,277 | 4/1953 | Belknap . | |
| 2,657,416 | 11/1953 | Smith . | |
| 2,659,925 | 11/1953 | Wood . | |
| 2,714,426 | 8/1955 | White . | |
| 2,824,335 | 2/1958 | Moffat . | |
| 3,030,650 | 4/1962 | Kiraly . | |
| 3,089,178 | 5/1963 | Sherman, Jr. . | |
| 3,177,635 | 4/1965 | Cawl et al. . | |
| 4,019,218 | 4/1977 | Cyphert . | |
| 4,163,650 | 8/1979 | Watson et al. . | |
| 4,310,945 | 1/1982 | Tribolet . | |
| 4,360,947 | * 11/1982 | DeCosa et al. | 15/352 X |
| 4,497,308 | * 2/1985 | Johnson | 15/327.2 X |
| 4,563,790 | 1/1986 | Clark . | |
| 4,571,250 | * 2/1986 | Irmscher | 55/429 X |
| 4,704,764 | * 11/1987 | Metelko | 15/327.1 X |
| 4,811,450 | 3/1989 | Steadings . | |
| 4,953,255 | 9/1990 | Jenkins . | |
| 5,455,983 | 10/1995 | Crouser et al. . | |
| 5,560,075 | 10/1996 | Jankowski . | |
| 5,819,368 | 10/1998 | Wang et al. . | |

FOREIGN PATENT DOCUMENTS

| | | |
|---|---|---|
| 196 07 959 | 9/1997 | (DE) . |
| 0 643 905 | 3/1995 | (EP) . |

* cited by examiner

*Primary Examiner*—Chris K. Moore
(74) *Attorney, Agent, or Firm*—Marshall, O'Toole, Gerstein, Murray & Borun

(57) ABSTRACT

A vacuum cleaner includes a receptacle with an interior, a motor assembly that draws air from the interior of the receptacle, an inlet on the receptacle wherein the inlet receives vacuumed material, and an opening on the receptacle in air flow communication with the interior of the receptacle. The vacuum cleaner also includes a dust pan that opens and closes the opening. The dust pan may be used for collecting large and small debris, liquids, and any other objects that cannot or should not enter the inlet.

19 Claims, 6 Drawing Sheets

FIG. 5
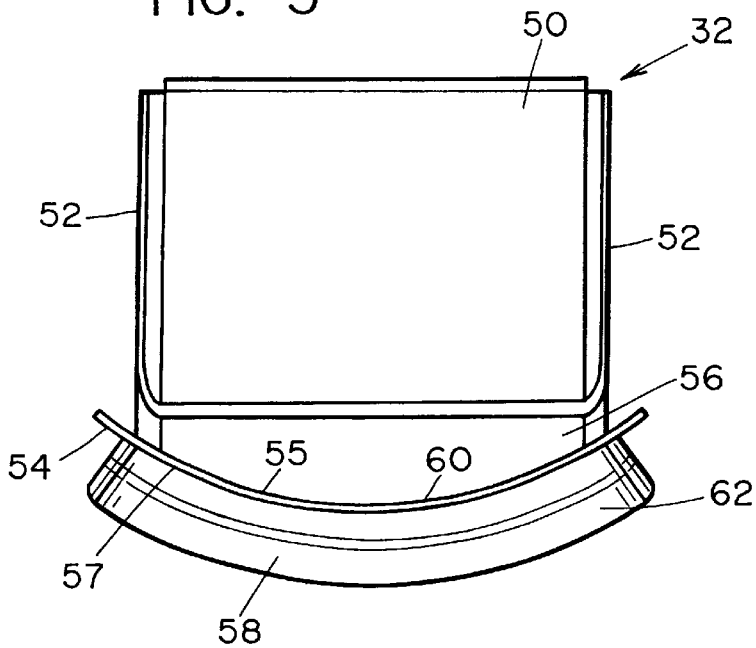
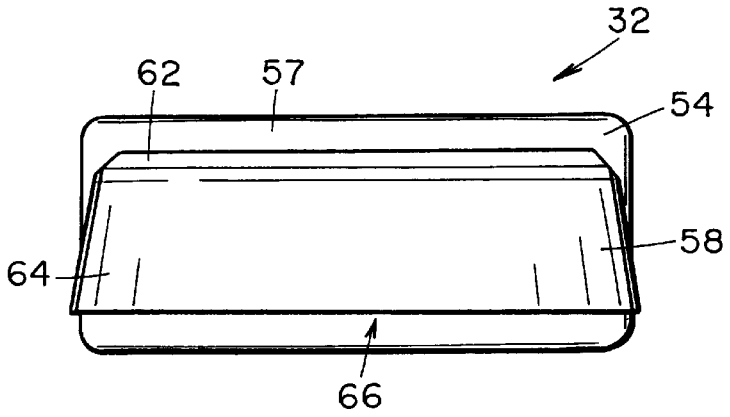
FIG. 6
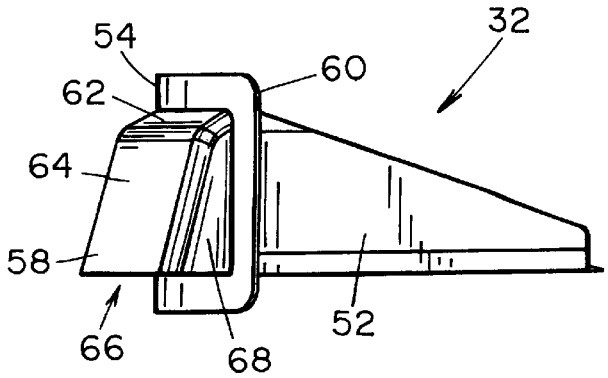
FIG. 7

DUST PAN CLOSURE FOR A VACUUM CLEANER

FIELD OF INVENTION

This invention relates generally to vacuum cleaners, and more particularly to devices that allow large debris to enter a vacuum cleaner.

BACKGROUND OF THE INVENTION

Vacuum cleaners generally include a motor assembly, a tank or other receptacle, a hose inlet on the receptacle, and a hose that attaches to the hose inlet at one end and has a nozzle at the other end. The motor of the motor assembly drives an impeller that creates a low pressure area inside the receptacle. The pressure difference between the inside and the outside of the receptacle creates a suction effect at the hose inlet, which causes dust, debris, and liquids to enter the receptacle through the hose.

The capability of vacuum cleaners to pick up large debris has been limited to debris that is smaller than the diameter of the hose. Further, even debris that is smaller than the hose diameter may clog the hose when passing through a bend in the hose. A large diameter hose for accepting large debris may not be acceptable because it will reduce the air velocity in the hose inlet, thus reducing the efficiency of the vacuum cleaner. Hoses are often used with nozzles which may have an even smaller cross section, and further increase the likelihood of clogging. Additionally, a hose with limited bending capability to allow passage of large debris reduces the versatility of the vacuum cleaner by making it ineffective for accessing hard to reach areas. Therefore, in most instances, a vacuum cleaner operator must manually pick up large debris and dispose of it by other means.

SUMMARY OF THE INVENTION

The dust pan closure for a vacuum cleaner of the present invention eliminates the drawbacks noted above in a simple and effective manner.

Particularly, a vacuum cleaner may include a receptacle with an interior and a motor assembly that draws air from the interior of the receptacle. The vacuum cleaner may further include an opening on the receptacle in air flow communication with the receptacle. The vacuum cleaner includes a dust pan, moveable between a first position closing the opening and a position in which the opening is not closed.

The dust pan may include a debris holding surface with a front edge, a back edge, and two side edges. The dust pan may further comprise a back wall, two side walls, and a handle. The back wall and the two side walls are attached to the back edge and the two side edges of the debris holding surface respectively. The handle is attached to the back wall. Additionally, the back wall may be curved and is larger in dimension than the largest cross section of the dust pan.

Other features and advantages of the present invention will become apparent from the specification and drawings, in which like reference numerals denote like structures.

BRIEF DESCRIPTION OF THE DRAWINGS

FIG. 5 is a top plan view of a dust pan of a vacuum cleaner of the present invention.

FIG. 6 is a front view of a dust pan of a vacuum cleaner of the present invention.

FIG. 7 is a side elevational view of a dust pan of a vacuum cleaner of the present invention.

DESCRIPTION OF THE PREFERRED EMBODIMENT

Figure 1:
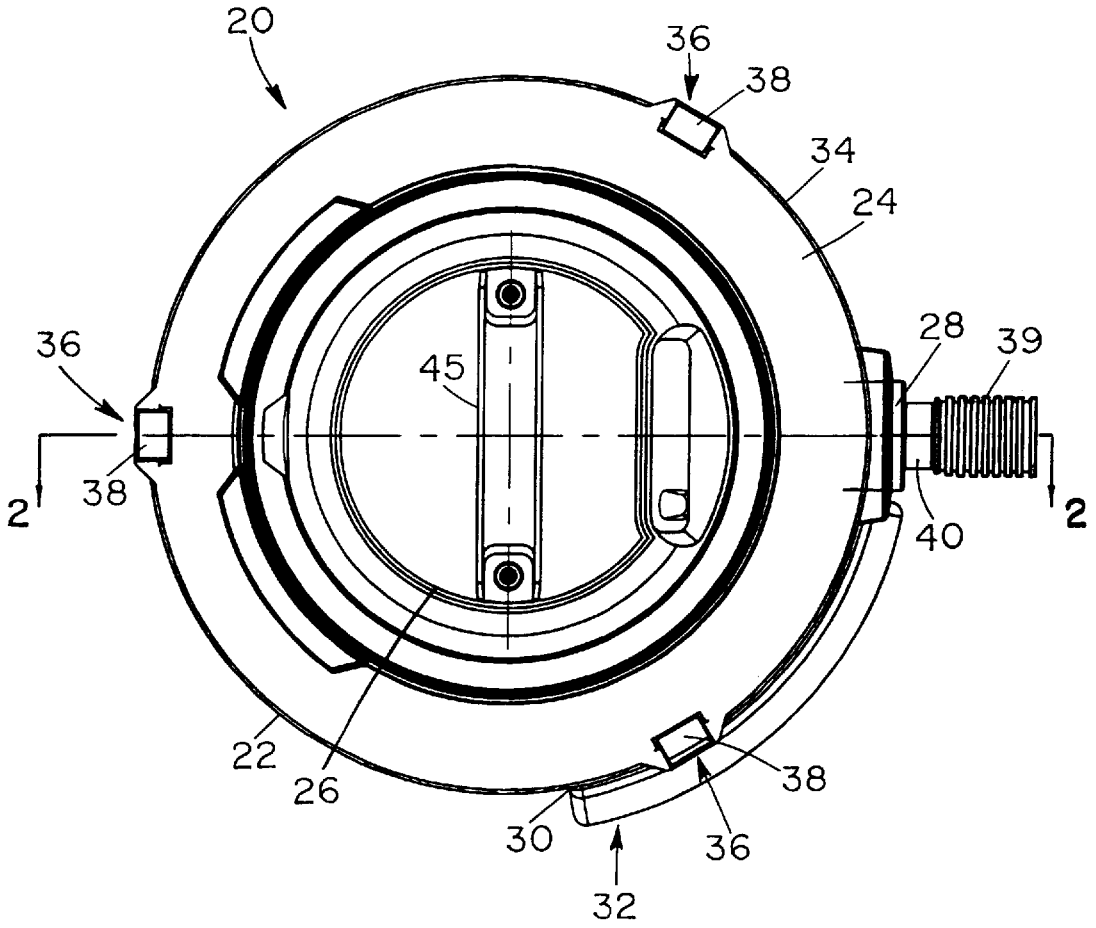
FIG. 1 is a top elevational view of a vacuum cleaner of the present invention.
Figure 2:
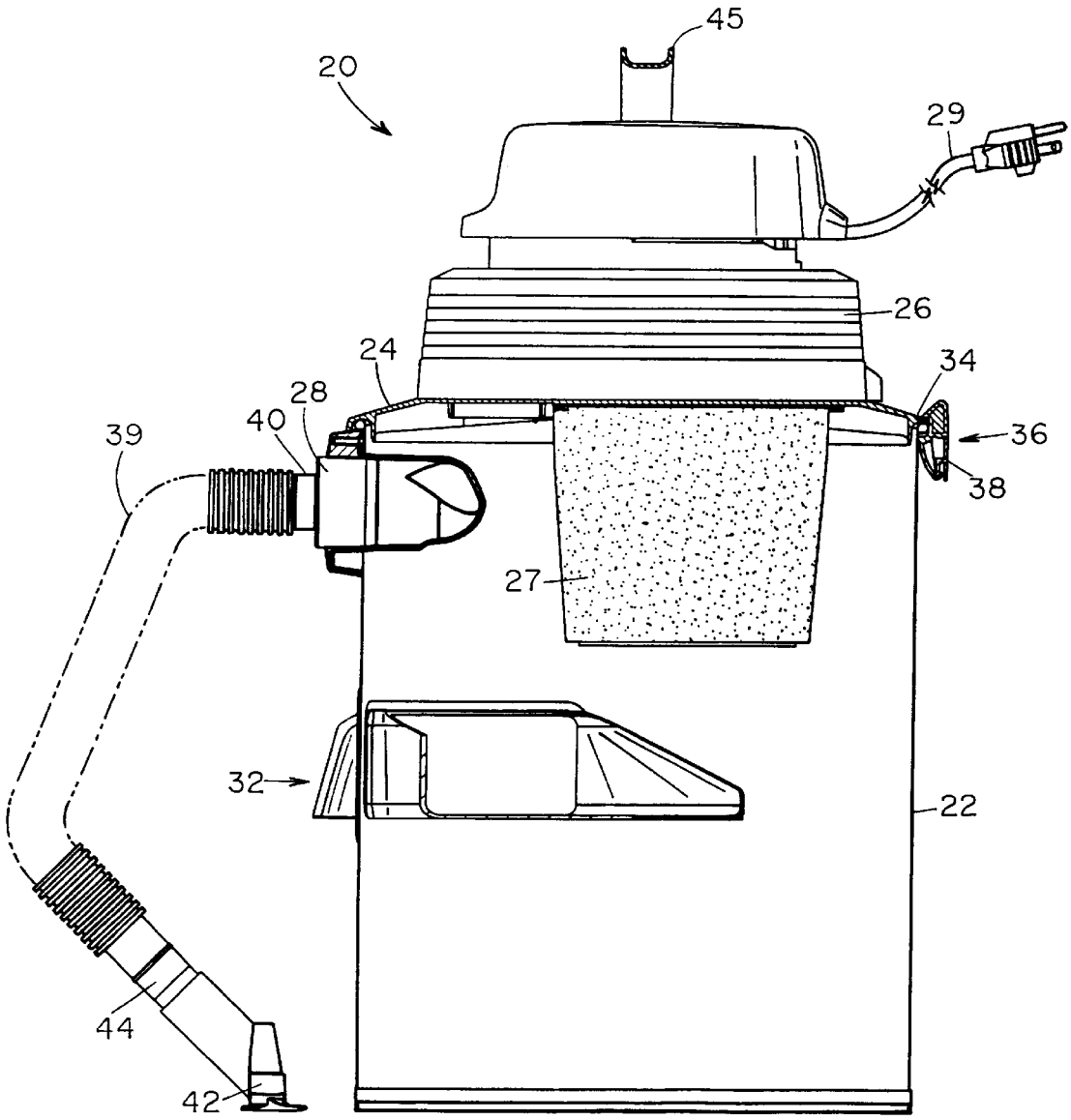
FIG. 2 is a partial cross-sectional view of the vacuum cleaner of FIG. 1 taken at the lines 2—2 of FIG. 1.

Referring initially to FIGS. 1–4, a vacuum cleaner 20 includes a receptacle 22, a lid 24 (FIGS. 1 and 2), a motor assembly 26 (FIGS. 1 and 2), a hose inlet 28 (FIGS. 1 and 2), an opening 30, and a dust pan 32 opening and closing the opening 30. The lid 24 has a rim 34 (FIGS. 1 and 2) which is designed to fit over the edge of the receptacle 22 for the vacuum cleaner 20. Around the periphery of the lid 24 are several latch ports 36 (FIG. 1) which cooperate with latches 38 (FIG. 1) on the receptacle 22 in order to hold the lid 24 on the receptacle. The lid 24 houses a motor assembly 26 that is in air flow communication with the receptacle 22 through a filter 27 (FIG. 2). Generally, the motor assembly 26 includes a power cord 29 (FIG. 2) for use with an electrical outlet, an electric motor, an air impeller, various housings, and other associated equipment (all not depicted) that create a low pressure area inside the receptacle 22. A hose 39 removably connects at a first end 40 to a hose inlet 28 on the receptacle 22. A nozzle 42 (FIG. 2) is attached at a second end 44 (FIG. 2) of the hose 39 for collecting debris. The vacuum cleaner 20 can be lifted and moved with a handle 45 (FIGS. 1 and 2) that is placed on the vacuum cleaner 20. Additionally, the vacuum cleaner 20 can be moved by rolling it on casters (not shown).

When the vacuum cleaner 20 is in operation, the low pressure created in the receptacle 22 by the motor assembly 26 creates a pressure difference between the receptacle 22 and the nozzle 42 to cause a suction effect at the nozzle 42. Small debris enters the nozzle 42, travels through the hose 39, and is deposited into the receptacle 22.

Figure 3:
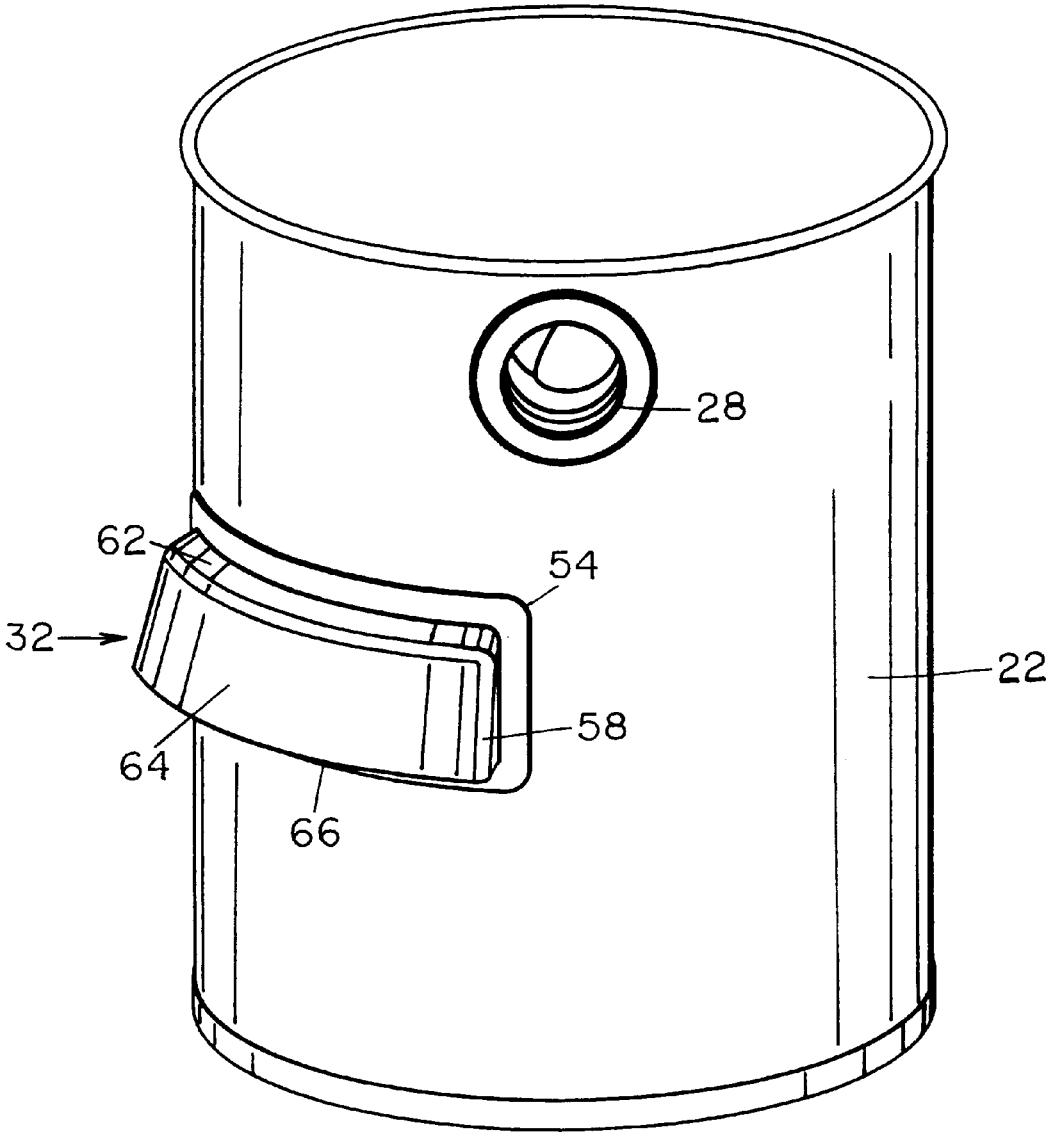
FIG. 3 is an isometric view of a receptacle of a vacuum cleaner of the present invention with the receptacle having an opening and a dust pan, wherein the dust pan is shown out of the opening.
Figure 4:
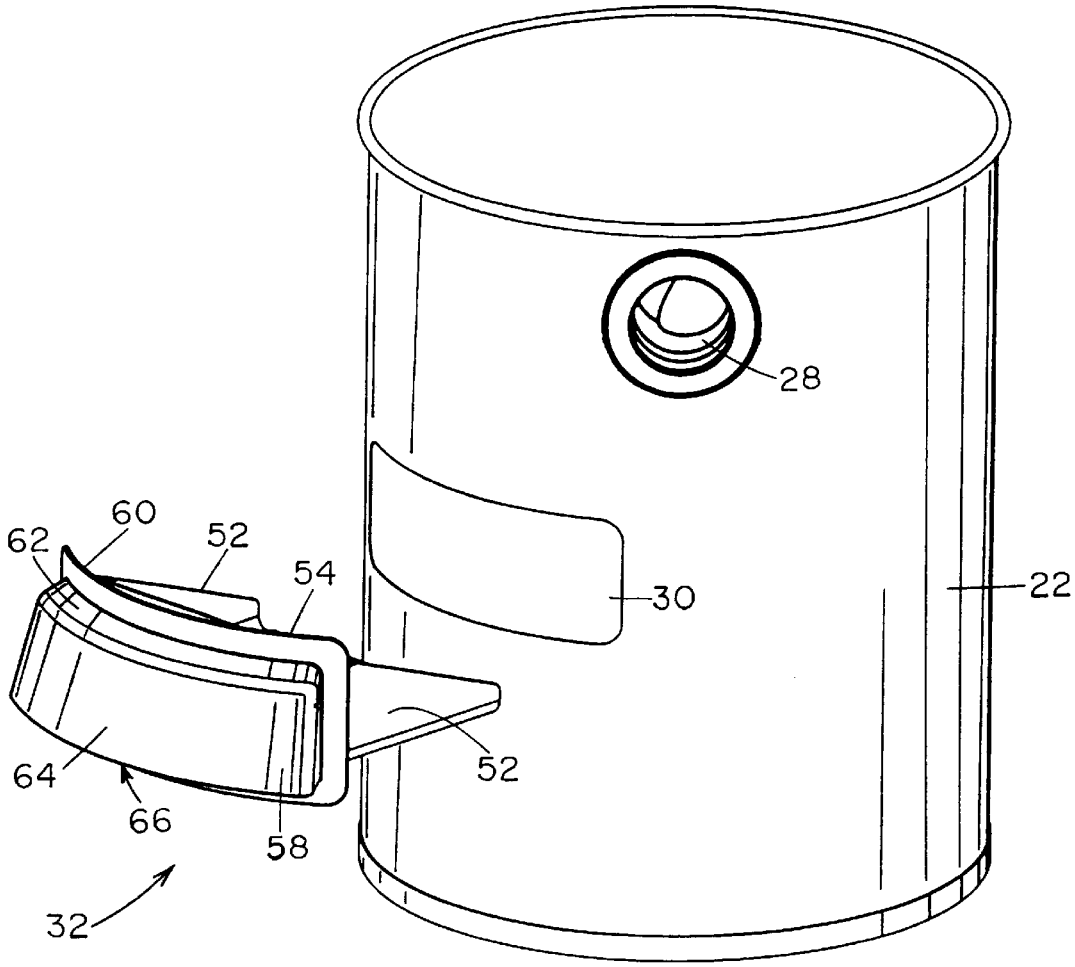
FIG. 4 is an isometric view of a receptacle of a vacuum cleaner of the present invention with the receptacle having an opening and a dust pan, wherein the dust pan is inserted in the opening.
Figure 8:
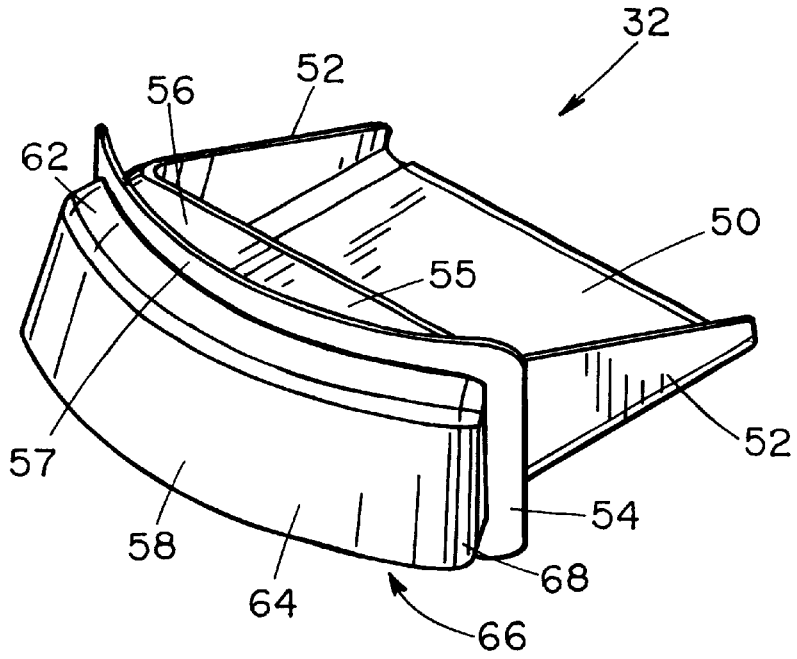
FIG. 8 is a front isometric view of a dust pan of a vacuum cleaner of the present invention.
Figure 9:
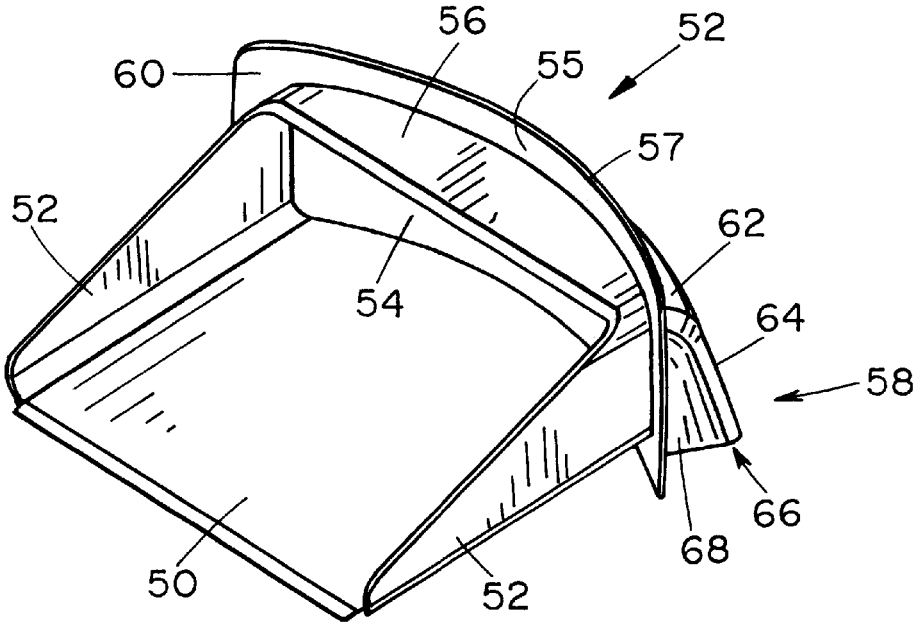
FIG. 9 is a back isometric view of a dust pan of a vacuum cleaner of the present invention.

As illustrated in FIGS. 3 and 4, the opening 30 accommodates large debris that cannot enter or that may become trapped inside of the hose 39. The dust pan 32 can be pulled out of the receptacle 22 to open the opening 30, and the dust pan 32 can be inserted into the opening 30 on the receptacle 22 to close the opening 30. A vacuum cleaner operator deposits large debris into the receptacle 22 in either of two ways. First, the vacuum cleaner operator can open the opening 30 by removing the dust pan 32, manually deposit large debris into the receptacle 22, and close the opening 30 by inserting the dust pan into the opening 30. Second, the vacuum cleaner operator can open the opening 30 by removing the dust pan 32, sweep dust, large or small debris, and liquids into the dust pan 32 with a broom, manually or otherwise, and close the opening 30 by inserting the dust pan 32 into the opening 30. It may be advantageous to sweep certain items, due to their size, shape or density, into the dustpan rather than attempting to draw them into the tank through the hose.

FIGS. 5–9 illustrate the dust pan 32 in greater detail. The dust pan 32 may comprise a dust and debris holding surface 50 (FIGS. 5, 8, and 9) that is partially enclosed on its sides by side walls 52 (FIGS. 5, 7, and 9) and fully enclosed at its back side by a back wall 54 (FIGS. 5–9). The top of the dust pan can be partially enclosed by a top section 56 (FIGS. 5, 8, and 9) that is attached to the back wall 54 and attached to the two side walls 52. The dust pan 32 may further include a handle 58 that is attached to the back wall 54 to facilitate handling of the dust pan 32 by a vacuum operator when removing or inserting the dustpan 32.

The side walls 52 prevent spillage of dust and debris from the sides of the holding surface 50. The portion of the back wall 54 that is inside the dust pan 32 and the top section 56 prevent spillage of dust and debris from the back side of the holding surface 50. The back wall 54 is curved, thus having a concave side 55 (FIGS. 5, 8, and 9) and a convex side 57 (FIGS. 5, 6, 8, 9). The back wall 54 extends beyond the boundaries of the cross section of the dust pan 32 by having larger dimensions than the dimensions of the largest cross section of the dust pan 32. The extension of the back wall 54 in combination with its curvature creates a curved surface 60 (FIGS. 5, 7, and 9) that is on the perimeter of the concave side 55 of the back wall 54. The curvature of the back wall 54 matches the curvature of the receptacle 22 at the location of the opening 30 on the receptacle 22. Consequently, as illustrated in FIG. 4, when the dust pan 32 is fully inserted into the receptacle 22 to close the opening 30, the curved surface 60 fits flush against the receptacle 22 to seal the opening 30. The outside surface of the top section 56, the outside surfaces of the side walls 54, and the outside surface of the holding surface 50 guide the dust pan 32 into the opening 30 when the dust pan 32 is being inserted into the opening 30, and secure the dust pan 32 from movement when it is fully inserted into the opening 30.

The handle 58 is attached to the convex side 57 of the back wall 54. The handle 58 may comprise a first section 62 (FIGS. 5–9) that extends away from the outside of the back wall 54, and a second section 64 (FIGS. 6–9) that is attached to the first section 62 and extends downwardly from the first section 62. The first section 62 and the second section 64 of the handle 58 provide a cavity 66 (FIGS. 6–9) under the handle 58 so that a vacuum operator can insert his/her fingers in the cavity 66 to pull the dust pan 32 out of the receptacle 22. The handle 58 may further comprise third sections 68 (FIGS. 7–9) that are attached to the first section 62 and the second section 64 on the sides of the handle 58 to reduce the flexure of the handle 58 when a vacuum cleaner operator is pulling the dust pan 32 out of the receptacle 22.

Although the present invention has been applied to tank or receptacle type vacuum cleaners, other types of vacuum cleaners, such as upright vacuum cleaners may be used in connection with the present invention. The opening and the dust pan of the present invention can be incorporated into any debris holding tank or receptacle component of other types of vacuum cleaners. The dust pan closure may be located in many areas of the vacuum cleaner, other than the side wall of the receptacle or tank as shown in FIGS. 1–4. For instance, the dustpan can be located on the lid of a receptacle or even on a compartment separate from but in air flow communication with the main tank or the receptacle.

The foregoing detailed description has been given for clearness of understanding only, and no unnecessary limitations should be understood therefrom, as modifications would be obvious to those skilled in the art.

What is claimed is:

1. A vacuum cleaner comprising:

a receptacle having an interior;

a motor assembly in air flow communication with the receptacle wherein the motor assembly draws air from the interior of the receptacle;

an inlet on the receptacle, wherein the inlet receives vacuumed material;

an opening on the receptacle in air flow communication with the interior of the receptacle; and a dust pan moveable between a first position closing the opening and a second position in which the opening is not closed.

2. The vacuum cleaner as recited in claim 1 wherein the dust pan is inserted in the opening to close the opening and pulled out of the opening to provide access to the opening.

3. The vacuum cleaner as recited in claim 1 wherein the inlet attaches to a hose.

4. The vacuum cleaner as recited in claim 1 wherein the dust pan comprises a debris holding surface having a front edge, a back edge, and two side edges.

5. The vacuum cleaner as recited in claim 4 wherein the dustpan comprises a back wall.

6. The vacuum cleaner as recited in claim 5 wherein the back wall is attached to the back edge of the debris holding surface.

7. The vacuum cleaner as recited in claim 5 wherein the back wall has larger dimensions than the dimensions of the largest cross section of the dust pan.

8. The vacuum cleaner as recited in claim 5 wherein the back wall is curved.

9. The vacuum cleaner as recited in claim 8 wherein the curvature of the back wall of the dust pan matches the curvature of the outside of the receptacle at where the opening is located on the receptacle.

10. The vacuum cleaner as recited in claim 8 wherein the back wall comprises a concave side and a convex side.

11. The vacuum cleaner as recited in claim 10 wherein the concave side of the back wall is attached to the back edge of the debris holding surface.

12. The vacuum cleaner as recited in claim 5 wherein the dustpan comprises two side walls attached to the two side edges of the debris holding surface.

13. The vacuum cleaner as recited in claim 12 wherein the two side walls extend from the back wall to the front edge of the debris holding surface.

14. The vacuum cleaner as recited in claim 13 wherein the side walls have a height, the height is greatest where the side walls attach to the back wall, and the height is smallest where the side walls meet the front edge of the debris holding surface.

15. The vacuum cleaner as recited in claim 13 wherein the dustpan comprises a top section attached to the side walls and the back wall.

16. The vacuum cleaner as recited in claim 15 wherein the top section partially covers the top of the dust pan.

17. The vacuum cleaner as recited in claim 5 wherein the dustpan comprises a handle.

18. The vacuum cleaner of claim 17 wherein the handle is attached to the back wall.

19. The vacuum cleaner as recited in claim 17 wherein:

the handle comprises a first section and a second section; and the first section extends away from the back wall, and the second section is attached to the first section and extends downwardly from the first section.

* * * * *